US005169375A

United States Patent [19]

Wächtler

[11] Patent Number: 5,169,375

[45] Date of Patent: Dec. 8, 1992

[54] SWIVEL-OUT STACKING DEVICE FOR AN ELECTROPHOTOGRAPHIC PRINTING DEVICE

[75] Inventor: Rudolf Wächtler, Munich, Fed. Rep. of Germany

[73] Assignee: Siemens Nixdorf Informationssysteme AG, Fed. Rep. of Germany

[21] Appl. No.: 741,428

[22] PCT Filed: Jan. 15, 1990

[86] PCT No.: PCT/DE90/00015

§ 371 Date: Aug. 8, 1991

§ 102(e) Date: Aug. 8, 1991

[87] PCT Pub. No.: WO90/09287

PCT Pub. Date: Aug. 23, 1990

[30] Foreign Application Priority Data

Feb. 10, 1989 [DE] Fed. Rep. of Germany ..... 3904042

[51] Int. Cl.[5] ..... B65H 45/00

[52] U.S. Cl. ..... 493/410; 271/213; 248/281.1; 248/284

[58] Field of Search ..... 271/207, 213; 493/410, 493/411, 412; 248/281.1, 284; 312/323; 414/789.9

[56] References Cited

U.S. PATENT DOCUMENTS

| | | | |
|---|---|---|---|
| 2,668,626 | 2/1954 | Stuivenberg | 414/789.9 |
| 4,474,567 | 10/1984 | Mugrauer et al. | 493/410 |
| 4,681,468 | 7/1987 | Kallin et al. | 400/120 |
| 4,842,573 | 6/1989 | Peter | 493/412 |
| 5,037,054 | 8/1991 | McConnell | 248/284 |
| 5,108,063 | 4/1992 | Koerber, Sr. | 248/284 |
| 5,110,101 | 5/1992 | Roth | 493/410 |

FOREIGN PATENT DOCUMENTS

| | | |
|---|---|---|
| 3346840A1 | 7/1985 | Fed. Rep. of Germany . |
| 1248539 | 10/1971 | United Kingdom . |

*Primary Examiner*—William E. Terrell
*Assistant Examiner*—Jack Lavinder
*Attorney, Agent, or Firm*—Hill, Van Santen, Steadman & Simpson

[57] ABSTRACT

A stacking device for the pre-folded continuous paper (13) of a high-speed printing device (10) is of swivel-out design. It can be swivelled out of a basic position (A) initially into a removal position (B) by means of a guide system without changing the output height of the paper deposit surface. By further swivelling it can be placed in an additional removal position (C), the height of which is adjustable.

3 Claims, 2 Drawing Sheets

SWIVEL-OUT STACKING DEVICE FOR AN ELECTROPHOTOGRAPHIC PRINTING DEVICE

BACKGROUND OF THE INVENTION

1. Field of the Invention

The invention relates to a stacking device for a recording carrier of a high-speed printing device, in particular of an electrophotographic printing device.

2. Description of the Related Art

Stacking devices of the type mentioned at the beginning are known from DE-C 3,115,511. Here, the device is an output device for a pre-folded paper web in a paper stacker of a high-speed printing device in which the paper web is stacked on a paper deposit surface. In order to make the removal of the paper stack easier, the paper deposit surface is designed such that it can be extended from the housing area of the printer in a drawer-like manner and has on the sides a telescopically extendable guide profile system.

The known device is constructed in such a way that it is insensitive with respect to transverse forces so that even large and heavy paper stacks can be freely removed through the housing without impediment.

In stacking devices of this kind the paper stack is located in the vicinity of the floor when the paper deposit surface is pulled out. This is ergonomically unfavourable because for the further transport of the printed paper stacks these paper stacks have to be lifted up. This is troublesome and cumbersome because of the weight of the paper stacks.

A thermal printing device is also known from U.S. Pat. No. 4,681,468 which is designed in the form of a journal printer. The thermal printing device is removably arranged in a piece of furniture in the form of an operating console. It consists of a backup container with a printing device arranged therein. The backup container contains permanently installed paper output areas for receiving the printed recording carrier and for receiving the unprinted recording carrier. A lever device arranged below the backup container permits the backup container to be moved together with the printing device out of the operator console. Thus, the printing device is accessible from all sides, which facilitates servicing the printing device and inserting and removing the recording carrier. The lever device itself consists of two levers arranged in the manner of a parallelogram which are connected in articulated fashion on the one hand to the backup container and on the other hand to the piece of furniture. A spring assigned to the levers supports the lifting of the printing device out of a lowered position into a locked service position.

SUMMARY OF THE INVENTION

The object of the invention is to design a stacking device of the type mentioned at the beginning in such a way that it can be integrated inside a high-speed printing device without a large degree of outlay and which permits an ergonomically optimum removal of the stack.

This object is achieved with a stacking device of the type mentioned at the beginning having a housing area for receiving a paper output area which is designed to be able to swivel out of the housing area and a delivery device, assigned to the housing area, for the recording carrier; a swivel device for the paper output area for swivelling the paper output area out of an output position in which the paper output area is located in the housing area below the output device into swivel positions with adjustable removal heights at which the paper output area is located outside the housing area, the swivel device having: at least one swivel lever which is mounted by means of a first fixed pivot centre in the housing area and by means of a second free pivot centre on the paper output area in such a way that when the paper output area swivels out of the output position a removal position is reached having a removal height corresponding to the output position, means which position the paper output area horizontally irrespective of the swivel position of the paper output area and a presettable, motor-driven drive device which is coupled to the swivel lever.

Advantageous embodiments of the invention are characterized in that a first rotationally fixed round element is arranged in the region of the first fixed pivot centre and a second round element which is rigidly connected to the paper output area is arranged in the region of the second free pivot centre, the round elements being coupled to one another by means of a ribbon-shaped element in such a way that when the swivel lever swivels, the round elements wind up or unwind the ribbon-shaped element and thus bring about a uniform horizontal position of the paper output area. The invention is further characterized in that the swivel device has only one swivel lever which engages on one side on the paper output area.

Since the stacking device has a guide system which is designed in such a way that it permits the paper deposit surface to be moved out of an output position located in the housing area into a removal position projecting out of the housing area and having adjustable height of the removal position with respect to the output position, the removal of the printed stack becomes particularly simple and ergonomically favourable.

In a first removal position, the paper deposit surface is swivelled out of the device without the output height having to be changed in order, for example, to move out the stack below the stack frame (delivery device).

This removal position is, for example, advantageous if low transport trolleys are used which are approximately at the same height as the paper deposit surface so that the stacks can be pushed in a simple manner from the paper deposit surface onto the loading area of the trolley.

If a trolley of this kind is not used, the operator can swivel out the paper deposit surface, which is in the form of a swivel-out lifting platform, into a presettable height by means of motor drive. In order to obtain the removal position which is favourable for him, the operator can freely select this removal height. This is important particularly when, for example, conveyor belts or paper processing machines such as, for example, paper cutting devices are provided.

In a particularly simple and user-friendly embodiment of the invention, the guide system which actuates the stacking device has only one swivel lever which engages on the paper deposit surface on one side.

As a result, when the stacking device is integrated in a printing device the entire paper deposit surface becomes freely accessible and the removal is not impeded by the guide system itself.

The entire stacking device can be arranged in a simple and space-saving manner inside a high-speed printing device which, for example, may be an electrophotographic printing device.

It is favourable if the stacking device is designed in accordance with DE-PS 3,115,511 so that the paper deposit surface is of fixed design whilst the delivery device is lifted by a drive device with increasing height of the paper stack.

The stacking device according to the invention can be integrated in a particularly simple manner in an electrophotographic printing device in such a way that the stacking device is located within the plan of the printer without substantial constructional modifications to the actual stacking device having to be carried out using output aids, feed channel etc.

However, the stacking device can also be used in printing devices which process individual sheets. For this purpose, merely an appropriately adapted delivery device (stacker frame) is necessary.

BRIEF DESCRIPTION OF THE DRAWINGS

One embodiment of the invention is illustrated in the drawings and is described below by way of example in greater detail.

DETAILED DESCRIPTION OF THE PREFERRED EMBODIMENTS

Figure 1:
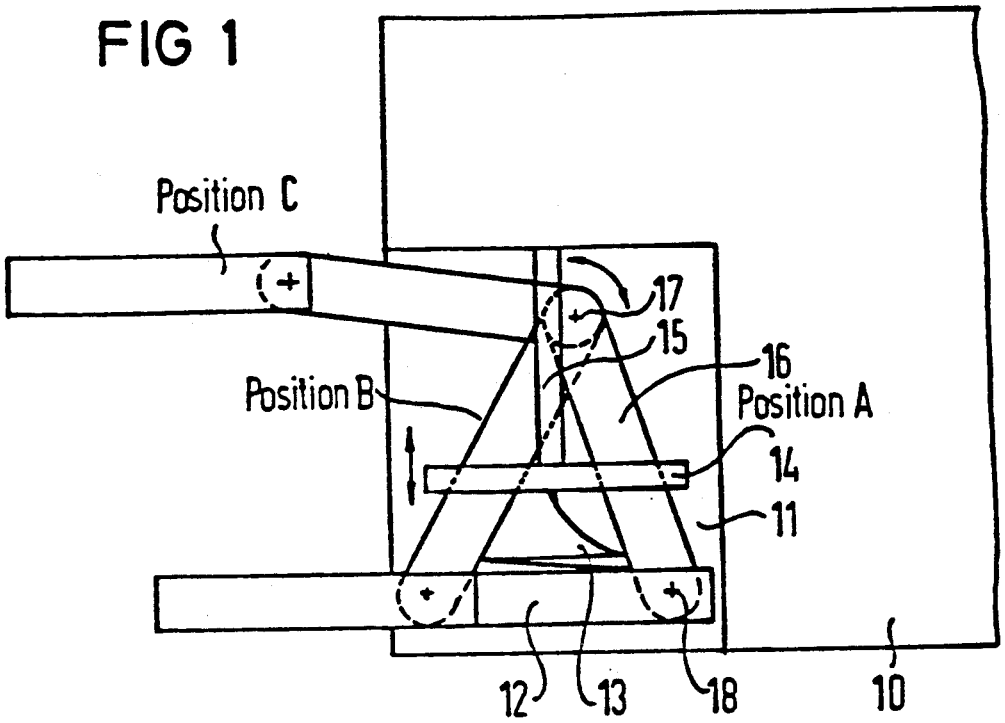
FIG. 1 shows a diagrammatic illustration of the stacking device according to the invention inside an electrophotographic printing device in a side view.

An electrophotographic printing device 10, which is not described here in detail, has a recess 11 in which a stacking device is provided for receiving the pre-folded continuous paper web which is printed in an electrophotographic process. The stacking device contains a paper deposit surface 12 on which the printed continuous paper 13 is deposited and a delivery device 14 which is lifted up with increasing height of the paper stack with the aid of a drive device (not illustrated here), and a guide channel 15 which changes its length a function of the movement of the delivery device. The delivery device can be designed according to DE-PS 3,115,511.

Figure 2:
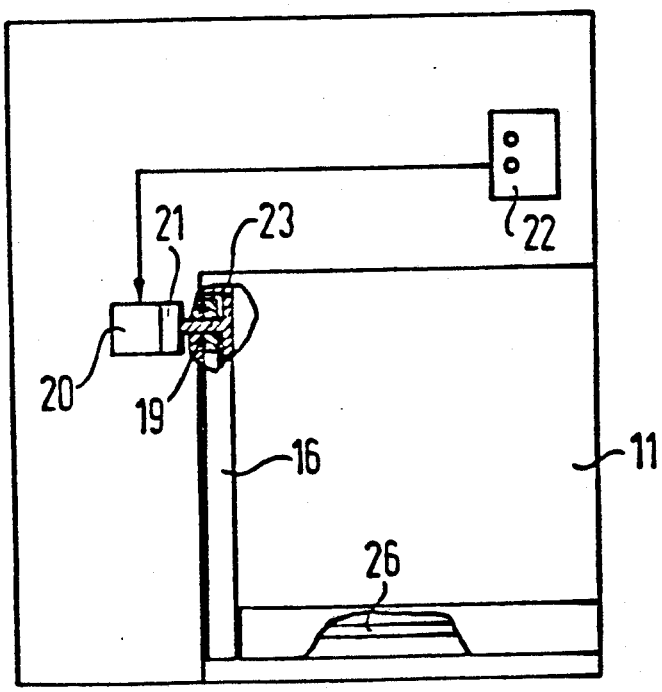
FIG. 2 shows a diagrammatic illustration of the same stacking device in a front view, partially in section

The paper deposit surface 12 is held and guided by means of a swivel lever 16 arranged on one side on the inside of the paper output area. The swivel lever 16 is rotatably attached by means of a first fixed pivot centre 17 to the inner surface of the recess 11 and by means of a second free pivot centre 18 to the paper deposit surface 12. As shown in FIG. 2, the swivel lever 16 connects in the region of the first fixed pivot centre 17 via a shaft 19 to a motor 20 with associated gearing 21. Instead of the motor 20, a lifting cylinder (hydraulic) or a lifting spindle can also be provided. The swivel direction indicated in FIG. 1 by means of arrows and the swivel travel can be preset by means of an operator panel 22 shown in FIG. 2, the operator panel being constructed in the customary manner. The motor 20 can be coupled, for example, to a timing disc and the operator panel 22 can contain memory elements for the number of revolutions to be aimed for and the direction of movement.

In order to ensure a horizontal position of the paper deposit surface 12 when swivelling the paper deposit surface 12, means are provided which guarantee horizontal position of the paper deposit surface regardless of the swivel position of the stacking device.

Figure 3:
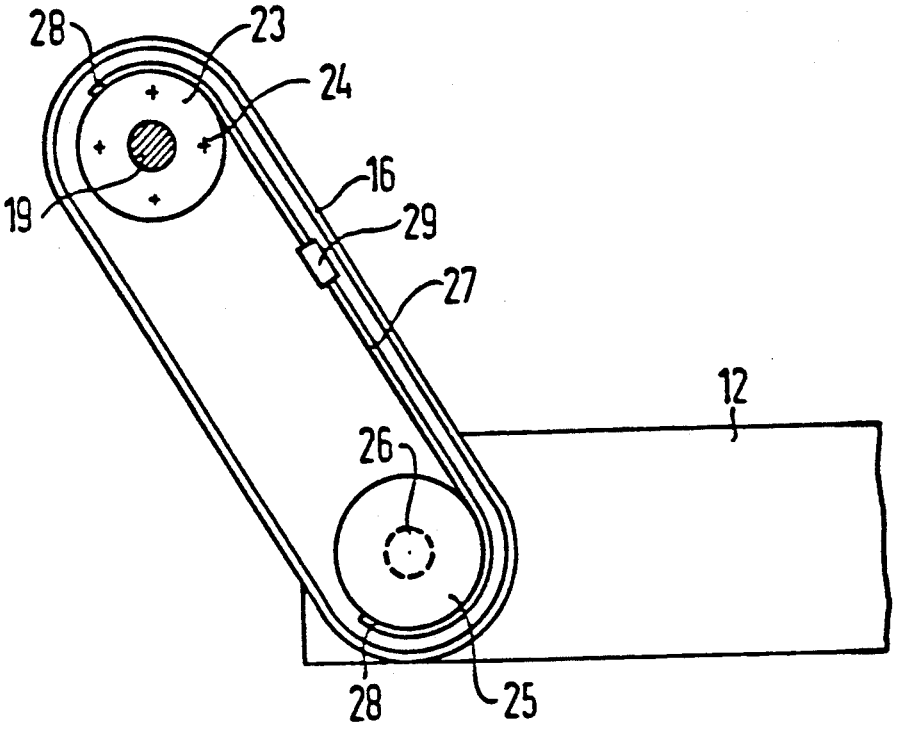
FIG. 3 shows a diagrammatic sectional view along the section line I—I of FIG. 2.

These consist in the illustrated exemplary embodiment of a round element 23 shown in FIG. 3 which is arranged in the region of the first fixed pivot centre 17 and is rigidly attached, for example by means of screws 24, to the housing of the printing device in the recess 11. In the region of the second free pivot centre 18 a second round element 25 which is rigidly connected to the paper deposit surface 12 is arranged. This round element 25 has an axle 26 which is rigidly connected to the paper deposit surface 12. The first and second round elements (23, 25) are coupled by means of a kinematic system (for example ribbon-shaped element) 27 for example in the form of a chain, the chain 27 being attached in each case with its ends to the circumference of the round elements by means of screws 28, for example. The chain is arranged in such a way that when swivelling the paper deposit surface 12 upwards by means of the swivel lever 16, the chain is released in the region of the first round element 23 and this free piece then winds up under the effect of the weight of the paper deposit surface 12 onto the second round element 25. As a result, when the swivel lever swivels upwards the paper deposit surface is lowered and maintains its horizontal position when swivelling provided that the first and second round elements have the same diameter. When swivelling back into the initial position, this movement is reversed. In order to preset the height position of the paper deposit surface 12 and for the purpose of adjustment, a turnbuckle 29 is arranged in the chain.

Instead of the round element chain system it is also conceivable to use a linkage which has, for example, the shape of a parallelogram and thus when the swivel arm swivels brings about a permanent horizontal position of the paper deposit surface or appropriately coupled gear wheels.

Furthermore, it is also possible, instead of only one swivel arm, to arrange two swivel arms in each case to the left and right of the paper deposit surface or a parallelogram-like linkage.

The function of the stacking device when swivelling is now described in greater detail with reference to FIG. 1. Different positions which the paper deposit surface can assume are designated by position A, position B and position C.

Starting from position A in which the paper deposit surface 12 is arranged directly underneath the delivery device 14 and which determines the operating position of the stacking device, the paper deposit surface 12 can be placed in a removal position B after the end of the stacking process by means of the motor 20 by entering a first removal position via the operating panel 22. In this case, the paper deposit surface is swivelled out of the printing device without the height of the paper deposit surface 12 being changed. As already described, the paper stack can easily be pushed from this position onto a correspondingly low transport device.

If the operator wishes to remove the paper stack at a height which is appropriate for and adapted to him, by entering the lifting height, for example in a digital manner via the operating panel 22 or by simply permanently actuating a push button, the paper deposit surface 12 can be swivelled by means of the motor 20 until it arrives in a position C in which the paper deposit surface is completely moved out of the printing device and is located at the same time at the desired removal height. This position can be stored, for example also for later swivel processes, in a memory of the operator panel 22 and used repeatedly. After removal of the paper stack 13, the paper deposit surface is moved back into the initial position (operating position) by renewed actuation of a return key on the operator panel 22.

The control device of the printing device and the motor 20 can be coupled in such a way that a removal and thus a swivelling out of the paper deposit surface 12 during the operation of the printing device is impossible or that activation of the printing device is only enabled when the paper deposit surface is swivelled in.

In order to reduce the risk of injury, in the illustrated exemplary embodiment the swivel lever 16 is constructed at the same time as a cover panel for the compensation means of the paper deposit surface. In this case, the swivel lever is guided in the region of the second free pivot centre 18 by the axle of the second round element 25.

Although other modifications and changes may be suggested by those skilled in the art, it is the intention of the inventors to embody within the patent warranted hereon all changes and modifications as reasonably and properly come within the scope of their contribution to the art.

I claim:

1. A stacking device for a recording carrier of a high-speed printing device, comprising:

a) a housing area receiving a paper deposit surface which is able to swivel out of the housing area, and receiving a delivery device, assigned to the housing area, for delivering the recording carrier onto the paper deposit surface;

b) a swivel means mounted to the paper deposit surface for swivelling the paper deposit surface out of an output position in which the paper deposit surface is located in the housing area below the delivery device into swivel positions with adjustable removal heights at which the paper deposit surface is located outside the housing area, the swivel device having:

b1) at least one swivel which is mounted by means of a first fixed pivot centre in the housing area and by means of a second free pivot centre on the paper deposit surface in such a way that the paper deposit surface swivels out of the output position to a swivel position having a removal height relative to the output position, b2) means for positioning the paper deposit surface horizontally irrespective of the swivel position of the paper deposit surface and b3) a presettable, motor-driven drive device which is coupled to the swivel lever for moving the paper deposit surface between the output position and the swivel positions.

2. A stacking device according to claim 1, wherein said means for positioning comprises a first rotationally fixed round element arranged in the region of the first fixed pivot centre and a second round element rigidly connected to the paper deposit surface in the region of the second free pivot centre, said round elements being coupled to one another by means of a ribbon-shaped element in such a way that when the swivel lever swivels, the round elements wind up or unwind the ribbon-shaped element and thus bring about a uniform horizontal position of the paper deposit surface.

3. A stacking device according to claim 1, wherein the swivel device comprises only one swivel lever which engages on one side of the paper deposit surface.

* * * * *